United States Patent [19]

Ozelton et al.

[11] Patent Number: 4,808,248

[45] Date of Patent: Feb. 28, 1989

[54] PROCESS FOR THERMAL AGING OF ALUMINUM ALLOY PLATE

[75] Inventors: Malcolm W. Ozelton, Torrance; James W. Bohlen, Fountain Valley; Gregory V. Scarich, Hermosa Beach; James J. Scuttl, Rancho Palos Verdes; Stephan W. Averill, Redondo Beach, all of Calif.

[73] Assignee: Northrop Corporation, Hawthorne, Calif.

[21] Appl. No.: 917,630

[22] Filed: Oct. 10, 1986

[51] Int. Cl.[4] ..... C22C 21/06

[52] U.S. Cl. ..... 148/12.7 A; 148/439

[58] Field of Search ..... 148/11.5 A, 12.7 A, 148/159, 439

[56] References Cited

U.S. PATENT DOCUMENTS

| | | | |
|---|---|---|---|
| 4,077,810 | 3/1978 | Ohuchi et al. | 148/12.7 A |
| 4,189,334 | 2/1980 | Dubost et al. | 148/159 |
| 4,200,476 | 4/1980 | Dubost et al. | 148/159 |
| 4,294,625 | 10/1981 | Hyatt et al. | 148/439 |
| 4,323,399 | 4/1982 | Dubost et al. | 148/159 |
| 4,336,075 | 6/1982 | Quist et al. | 148/12.7 A |
| 4,661,172 | 4/1987 | Skinner et al. | 148/439 |

*Primary Examiner*—Stephen J. Lechert, Jr.

*Attorney, Agent, or Firm*—Terry J. Anderson; Robert B. Block

[57] ABSTRACT

A method is disclosed for preparing an improved aluminum alloy plate product wherein the plate produced from an Al-Li-Cu-Mg alloy in the T351 condition is subjected to a thermal aging treatment wherein the plate is exposed to a temperature of about 170° C.±2° C. for about 32 hours ±0.5 hours.

2 Claims, No Drawings

PROCESS FOR THERMAL AGING OF ALUMINUM ALLOY PLATEcl BACKGROUND OF THE INVENTION

1. Field of the Invention

This invention relates to the production of improved aluminum alloy plate and more particularly the invention relates to an improved thermal aging process for aluminum alloy plate in which the aluminum alloy contains substantial amounts of lithium.

2. The Prior Art

There is considerable current interest in aluminum alloys containing substantial amounts of lithium, for example 1–3%. Lithium containing aluminum alloys have been shown to exhibit very high strength/weight ratios and amongst these alloys, Al-Li-Cu-Mg alloys show particularly interesting possibilities. Thus, the high strength to weight ratios of these alloys renders them highly suited for use applications such as structural components for aircraft.

An Al-Li-Cu-Mg alloy in plate form is commercially available in gauges from 0.25 to 2.0 inch thicknesses from Alcan International Limited under the designation X8090 aluminum alloy and is supplied in the T351 condition, that is, the plate is solution heat treated, quenched, stretched plastically 2 to 4 percent and room temperature aged. When the X8090 plate is subjected to the thermal aging treatment recommended by the manufacturer, namely 64–72 hours at 170° C. or 16 hours at 190° C., the plate develops typical tensile and yield strength levels of, respectively, 78 and 70 ksi. Although the tensile properties of the thermally aged X8090 plate renders the plate useful in many aircraft structural applications, for certain fracture and fatigue critical applications, such as wing or pressurized fuselage skin, however, the aircraft industry is desirous of improving the fracture toughness and fatigue life of the alloy plate.

It is therefore an object of the present invention to provide a plate of an aluminum alloy of the system Al-Li-Cu-Mg for use in structural components of aircraft that exhibits improved fracture toughness and fatigue resistance while maintaining the tensile strength at a level approximately equivalent to that of the manufacturer's recommended thermally aged Al-Li-Cu-Mg alloy plate.

SUMMARY OF THE INVENTION

The method of the present invention fulfills the foregoing object wherein an Al-Li-Cu-Mg alloy plate in an unaged condition is subjected to a thermal aging treatment comprised of heating the T351 condition plate at a temperature of about 170° C. ±2° C. for about 32 hours ±0.5 hours.

As will hereinafter be further illustrated, the thermal aging treatment of the present invention improves the fracture toughness and fatigue life of the Al-Li-Cu-Mg alloy plate especially when compared to the identical plate aged in accordance with prior art thermal aging procedures.

DESCRIPTION OF THE PREFERRED EMBODIMENTS

The composition of the Al-Li-Cu-Mg alloy used to prepare the plates thermally aged in accordance with the present invention is comprised of about 1 to 3% Li, 0.5 to 2% Cu, 0.2 to 2% Mg, the balance of the alloy being aluminum and trace elements. Of the trace elements present, the maximum allowable amount of Fe +Si is about 0.4%, and that of Mn +Cr +Zr is about 0.6%. For any other trace elements in the alloy, the maximum allowable amount of any one such element is 0.05% and the total allowable amount of other trace elements 0.15%. (The foregoing percentages are weight percentages based on the total alloy). A full description of the Al-Li-Cu-Mg system alloy is contained in U.S. Pat. No. 4,526,630, the disclosure of which is incorporated herein by reference.

To prepare the aluminum alloy plate, the alloy is cast, and then hot worked to provide a wrought plate product. The plate product is then solution treated, cold water quenched stretched plastically 2 to 4 percent and aged at room temperature for at least 5 days to the T351 condition.

The T351 condition plate is then thermally aged in accordance with the process of the present invention at 170° C. ±2° C. for 32 hours ±0.5 hours in a furnace or other conventional heating device to provide a plate product having substantially undiminished tensile properties and substantially improved fracture toughness and fatigue properties compared with plates having the same composition which have been aged with previous thermal aging processes.

Described below is an example of which the novel thermal aging treatment of the present invention was effected on a sample of an X8090 aluminum alloy plate available from Alcan International, Inc. The X8090 alloy was identified as having the composition 2.5 %Li, 1.2 %Cu, 0.7 %Mg, 0.1 %Zr, the balance being aluminum.

EXAMPLE

X8090 plate of thicknesses of 0.65 and 1.0 inch were obtained from Alcan International, Inc. The plate was received in T351 condition. The plate was thermally aged at 170° C. for 32 hours in a circulating air furnace. Tensile strength in the longitudinal, long transverse and short transverse directions as well as fracture toughness and spectrum fatigue life tests were then run on specimens taken from the thermally aged plate. The data from these tests are summarized in the Table below.

Tensile tests in the longitudinal direction were run in the conventional manner.

The long transverse and short transverse tensile tests were conducted according to ASTM B557 entitled, "Tension Testing of Wrought and Cast Aluminum and Magnesium Products" using subsize and miniature round specimens loaded in Instron test machines. These tensile tests are a measure of the strength and ductility of the specimen material.

The fracture toughness tests were also run in a conventional manner at room temperature using compact tension specimens prepared in accordance with ASTM E399 entitled "Plane-Strain Fracture Toughness of Metallic Materials," using MTS test machines. The fracture toughness test measures, in units of 1000 psi, square root inch (Ksi $\sqrt{in}$) the alloy material's resistance to unstable crack growth when loaded in the longitudinal (L) direction parallel to the rolling direction with the crack in the transverse (T) direction perpendicular to the rolling direction (L-T) and vice-versa (T-L).

Spectrum Fatigue Life tests were run using large 16 inch long ×4 inch wide alloy specimens provided with a small center hole having a starter crack which specimens were loaded in a sequence of different loads under computer control to simulate loading of an aircraft component. Spectrum life is a measure of the alloy material's resistance to growth of the cracks from the hole.

A F-18 TC Spectrum (simulated flight hours) test comprised of a sequence of tension and compression loads simulating a period of flight for the F-18 tail hinge moment was also run to determine the resistance of the alloy material to the growth of a small preexisting crack under the expected loading for the aircraft component. A F-18 TD Spectrum (simulated flight hours) test was run similar to the F-18 TC Spectrum (simulated flight hours test) except the test was comprised of a sequence of tension dominated loads (with some compression) simulating a period of flight encountered by an F-18 wing component.

For the purposes of comparison, the procedure of the Example was repeated with the exception that the X8090 plate was aged using two separate prior art thermal aging treatments, one at 170° C. for 64 hours and the second at 190° C. for 16 hours. Tensile, fracture toughness, spectrum fatigue life and F-18 TC and TD spectrum tests were also run on the X8090 plate thermally aged in accordance with the comparative prior art thermal aging treatments. The results of these comparative tests are also recorded in the Table below.

TABLE

| | X8090 Plate Properties | | |
|---|---|---|---|
| | Present Invention Thermal Aging Treatment | Prior Art Comparative Thermal Aging Treatments | |
| Property | 32 h/170° C. | 64 h/170° C. | 16 h/190° C. |
| A. TENSILE | | | |
| Longitudinal | | | |
| Ultimate (ksi) | 74 | 78 | — |
| Yield (ksi) | 65 | 70 | — |
| Elongation (%) | 6.5 | 6.5 | — |
| Long Traverse | | | |
| Ultimate (ksi) | 73 | 77 | — |
| Yield (ksi) | 62 | 67 | — |
| Elongation (%) | 7 | 7 | — |
| Short Traverse | | | |
| Ultimate (ksi) | 66 | — | 65 |
| Yield (ksi) | 49 | — | 53 |
| Elongation (%) | 2.2 | — | 0.7 |
| B. FRACTURE TOUGHNESS | | | |
| L-T (Ksi $\sqrt{in}$) | 30 | 27 | — |
| T-L (Ksi $\sqrt{in}$) | 35 | 29 | — |
| C. SPECTRUM FATIGUE LIFE | | | |
| F-18 TC Spectrum (simulated flight hours) | 52,010 | 43,844 | — |
| F-18 TD Spectrum (simulated flight hours) | 102,830 | — | 49,555 |

The data in the Table demonstrate that X8090 Al-Li-Cu-Mg-Zr alloy plate thermally aged in accordance with the process of the present invention exhibits substantially superior fracture toughness and fatigue properties especially when compared to identical plate thermally aged in accordance with comparative prior art processes with only minimal reductions in the tensile properties of the sheet. The data in the Table further illustrate that the X8090 alloy thermally aged in accordance with the present invention when tested in the short traverse direction exhibits substantially the same ultimate and yield strengths as the same alloy treated with a comparative prior art thermal aging process (16*h*/190° C.) but the elongation exhibited by the alloy treated in accordance with the process of the present invention is 2.2% as compared to 0.7% for the comparative prior treated alloy thereby indicating a significant increase in the ductility of the alloy without a significant change in the ultimate or yield strengths of the alloy.

While specific components of the present system are defined above, many other variables may be introduced which may in any way affect, enhance, or otherwise improve the system of the present invention. These are intended to be included herein.

Although variations are shown in the present application, many modifications and ramifications will occur to those skilled in the art upon a reading of the present disclosure. These, too, are intended to be included herein.

What is claimed is:

1. In a method of producing an aluminum alloy product prepared from an 8090 Al-Li-Cu-Mg-Zr alloy cast ingot wherein the cast ingot is hot worked into a wrought product then solution heat treated, quenched, stretched 2 to 4 percent to the T351 condition, the improvement comprising subsequently subjecting the product to a thermal aging treatment by a single exposure to a temperature of about 170° C. +/−2° C. for about 32 +/−0.5 hours to obtain improved fracture toughness and fatigue resistance.

2. The method of claim 1 wherein the alloy is comprised of about 2.5% Li, 1.2% Cu, 0.7% Mg, 0.1% Zr.

* * * * *